US008585307B2

(12) United States Patent
Bouix et al.

(10) Patent No.: US 8,585,307 B2
(45) Date of Patent: Nov. 19, 2013

(54) SYSTEM FOR SAMPLING A HEATED PRODUCT

(75) Inventors: Herve F. Bouix, New York, NY (US); Francis Corbellini, Thiais (FR); Christophe Jacob, Rouen (FR)

(73) Assignee: ELC Management, LLC, New York, NY (US)

( * ) Notice: Subject to any disclaimer, the term of this patent is extended or adjusted under 35 U.S.C. 154(b) by 526 days.

(21) Appl. No.: 12/980,526

(22) Filed: Dec. 29, 2010

(65) Prior Publication Data

US 2012/0170961 A1 Jul. 5, 2012

(51) Int. Cl.
*A46B 11/00* (2006.01)

(52) U.S. Cl.
USPC ..... 401/129; 401/126; 401/1

(58) Field of Classification Search
USPC ..... 401/1, 2, 126, 128–130; 132/218, 318, 132/320; 219/209, 222–229
See application file for complete search history.

(56) References Cited

U.S. PATENT DOCUMENTS

| | | | |
|---|---|---|---|
| 2,488,591 | A | 11/1949 | Fevas |
| 3,518,410 | A | 6/1970 | Dillarstone |
| 4,067,480 | A | 1/1978 | Gasser |
| 4,274,588 | A | 6/1981 | Schwob |
| 4,291,685 | A | 9/1981 | Taelman |
| 4,329,567 | A | 5/1982 | Kunz et al. |
| 4,465,073 | A | 8/1984 | Schwob |
| 4,538,630 | A | 9/1985 | Henderson |
| 4,733,784 | A | 3/1988 | Bennett |
| 4,889,440 | A | 12/1989 | Shano |
| 5,096,319 | A | 3/1992 | Gueret |
| 5,395,175 | A | 3/1995 | Bontoux et al. |
| 5,513,771 | A | 5/1996 | Cote |
| 5,556,468 | A | 9/1996 | Legrain et al. |
| 5,775,344 | A | 7/1998 | Clay |
| 5,851,079 | A | 12/1998 | Horstman et al. |
| 5,853,010 | A | 12/1998 | Suh |
| 5,911,226 | A | 6/1999 | Vecchiola et al. |
| 6,009,884 | A | 1/2000 | Suh |
| 6,454,127 | B1 | 9/2002 | Suomela et al. |
| 6,508,603 | B1 | 1/2003 | Vasas |
| 6,911,010 | B2 | 6/2005 | Dirks et al. |

(Continued)

FOREIGN PATENT DOCUMENTS

| | | |
|---|---|---|
| DE | 19839940 | 3/2000 |
| EP | 1563760 | 8/2005 |

(Continued)

OTHER PUBLICATIONS

PCT International Search Report; International Application No. PCT/US2011/066229; Completion Date: Aug. 28, 2012; Date of Mailing: Aug. 29, 2012.

(Continued)

*Primary Examiner* — David Walczak
(74) *Attorney, Agent, or Firm* — Peter Giancana

(57) ABSTRACT

A system for sampling a heated product comprising a disposable first subassembly and a physically separate reusable second subassembly. Prior to use, the two subassemblies are able to form a rigid connection. As a result of forming this connection, a portion of an electric heating circuit is inserted into an interior space of an applicator head. After forming the connection, the first subassembly is broken, the electric heating circuit is turned on, and the applicator head is used to apply product.

29 Claims, 11 Drawing Sheets

(56) References Cited

U.S. PATENT DOCUMENTS

| | | | | |
|---|---|---|---|---|
| 7,083,347 | B2 | 8/2006 | Marcotte et al. | |
| 7,086,861 | B2 | 8/2006 | Pitz et al. | |
| 7,090,420 | B2 * | 8/2006 | De La Poterie et al. | 401/1 |
| 7,108,438 | B2 | 9/2006 | Fontaine | |
| 7,227,108 | B2 | 6/2007 | Clothier et al. | |
| 7,322,366 | B2 | 1/2008 | Cho | |
| 7,448,814 | B2 | 11/2008 | Bouix et al. | |
| 7,465,114 | B2 | 12/2008 | Kress et al. | |
| 7,669,605 | B2 | 3/2010 | Cho | |
| 7,753,609 | B2 | 7/2010 | Bouix et al. | |
| 7,909,044 | B2 | 3/2011 | Tranchant et al. | |
| 7,980,776 | B2 | 7/2011 | Cho | |
| 2004/0096258 | A1 | 5/2004 | Kim | |
| 2004/0247367 | A1 | 12/2004 | Fontaine | |
| 2005/0013838 | A1 | 1/2005 | De La Poterie | |
| 2005/0031656 | A1 | 2/2005 | Pays et al. | |
| 2005/0244209 | A1 | 11/2005 | Gueret | |
| 2005/0258172 | A1 | 11/2005 | Gueret | |
| 2006/0032512 | A1 | 2/2006 | Kress et al. | |
| 2006/0246118 | A1 | 11/2006 | Gueret | |
| 2006/0251686 | A1 | 11/2006 | Gueret | |
| 2007/0206986 | A1 | 9/2007 | Gueret | |
| 2008/0273911 | A1 | 11/2008 | Gueret | |
| 2009/0020133 | A1 | 1/2009 | Gueret | |
| 2010/0054841 | A1 | 3/2010 | Cho | |
| 2010/0086507 | A1 | 4/2010 | Gueret | |
| 2011/0076085 | A1 | 3/2011 | Jollet et al. | |

FOREIGN PATENT DOCUMENTS

| | | |
|---|---|---|
| FR | 2891394 | 3/2007 |
| GB | 2174896 | 11/1986 |
| WO | 2007/114551 | 10/2007 |

OTHER PUBLICATIONS

PCT Written Opinion of the International Searching Authority; International Application No. PCT/US2011/066229; Completion Date: Aug. 28, 2012; Mailing Date: Aug. 29, 2012.

Related Application: Bouix, et al., "Heating Applicator System for Products That May Be Degraded by Heat," U.S. Appl. No. 13/330,765, filed Dec. 20, 2011.

Related Application: Bouix, et al., Bouix, et al., "Capacitor Powered Personal Care Devices," U.S. Appl. No. 13/100,806, filed May 4, 2011.

Minco, Thermofoil Heaters (on-line), 2005 (Retrieved on Mar. 22, 2006). Retrieved from the Internet: URL: http://www.minco.com/products/heaters.aspx.

International Search Report mailed Mar. 3, 2008, of PCT/US07/69759.

Written Opinion of the ISA dated Mar. 3, 2008, of PCT/US07/69759.

Related Application: Boux and Jacob, "Heated Mascara Applicator and Suitable Compositions," U.S. Appl. No. 12/732,835, filed Mar. 26, 2010.

Related Application: Boux and Jacob, "Heated Mascara Applicator and Suitable Compositions," U.S. Appl. No. 11/422,729, filed Jun. 7, 2006.

Related Application: Bouix and Jacob, "Cosmetic Applicators Containing Heating Elements," U.S. Appl. No. 12/730,789, filed Mar. 24, 2010.

Related Application: Bouix, et al., "Reuseable Pump Dispenser for Heated Personal Care Compositions," U.S. Appl. No. 12/948,840, filed Nov. 18, 2010.

* cited by examiner

SYSTEM FOR SAMPLING A HEATED PRODUCT

INTRODUCTION

The present invention is in the field of cosmetic and personal care products. In particular, the present invention concerns a system for offering free samples of heated mascara or other product, to a potential customer.

BACKGROUND

Heating mascara applicators have only recently begun to appear on the market, and their presence in the marketplace may grow significantly in years to come. One impediment to market acceptance is lack of familiarity with a heated mascara application. In order to promote this relatively new type of product, vendors might like to offer potential customers, a sample of heated mascara in the store. The main problems associated with offering free samples in the store include the need to keep costs down, and the need to maintain sanitary conditions for customers. Sanitary conditions can be maintained by providing each potential customer with her own reservoir of product and her own, never-before-used applicator. Costs may be kept low by reducing the amount of packaging that is disposed after each product sampling. Because heated mascara applicators are considerably more expensive to manufacture than conventional, non-heated applicators, the idea of providing each potential customer with a free sample may be prohibitive. The present invention addresses this problem, and makes offering a free sample of heated mascara sanitary and cost effective.

OBJECT OF THE INVENTION

One object of the invention is to provide a system for sampling a heated product that alleviates problems that may be encountered in a point of sale setting.

Another object of the invention is to provide a system for sampling a heated product that makes offering a free sample of heated mascara sanitary and cost effective.

SUMMARY

This summary is provided merely as an introduction and does not, by itself, limit the appended claims. According to one aspect, the present invention is a single use applicator head, initially mounted in, on or to a single use reservoir of product. The mounting of the applicator head seals the reservoir to protect the product in the reservoir prior to use. A reusable handle, stem and power source are able to be attached and detached from the applicator head. When the handle, stem and power source are attached to the applicator head, heating elements are disposed inside the applicator head for heating product in the reservoir and on the applicator head, and the applicator head can be removed from its mounting in, on or to the reservoir. When sampling is completed, the applicator head is detached from the reusable stem, handle and power source. For hygienic reasons, the applicator head and reservoir are disposed, while the handle, stem and power source are reused. The following description should not be construed as limiting the scope of this invention, except as set forth in the claims.

DESCRIPTION OF THE FIGURES

FIGS. 13*a* and 13*b* show a first subassembly joined to a second subassembly, after the elongated neck has been detached from the reservoir. The electric heating circuit is on.

DEFINITIONS

"Product application temperature" means a temperature of the product that is greater than ambient temperature, at which some characteristic of the product is enhanced or improved. For example, ambient temperature may be taken to be 20° to 25° C., while product application temperature may be 30° C. or greater, or 40° C. or greater, or 50° C. or greater, or 60° C. or greater, and so on, as the situation dictates. The improved characteristic may relate to application of the product to the skin or hair, or it may relate to the performance or shelf life of the product. Furthermore, the improved characteristic may relate to a consumer's experience or expectation of the product. For example, the characteristic improvement may be a pre-defined reduction in viscosity. Or, for example, it may be activation of an active ingredient above a threshold temperature. Or, for example, the improved characteristic may be longer shelf life due to a reduction in harmful microbes in the product. Or the improved characteristic may be a feeling of warmth, experienced by the consumer.

"Handheld applicator" means an applicator that is intended to be held in one, or at most, two hands, and raised in the air as the applicator is performing one or more main activities. Main activities include using the applicator to transfer product from the reservoir to an application surface. Thus, "handheld" means more than just being able to grasp an object. For example, a "space heater" does not meet this definition of handheld.

Throughout the specification "comprise" means that an element or group of elements is not automatically limited to those elements specifically recited, and may or may not include additional elements.

Throughout the specification, "electrical contact" means that, if a potential difference is provided between electronic elements, then an electric current is able to flow between those elements, whether there is direct physical contact between the elements or whether one or more other conductive elements intervene.

Various features of some of the embodiments will now be described. Certain described features may be used separately or in combination with other described or implied features. Some of the embodiments may use only one or more described features.

DETAILED DESCRIPTION

Figure 1:
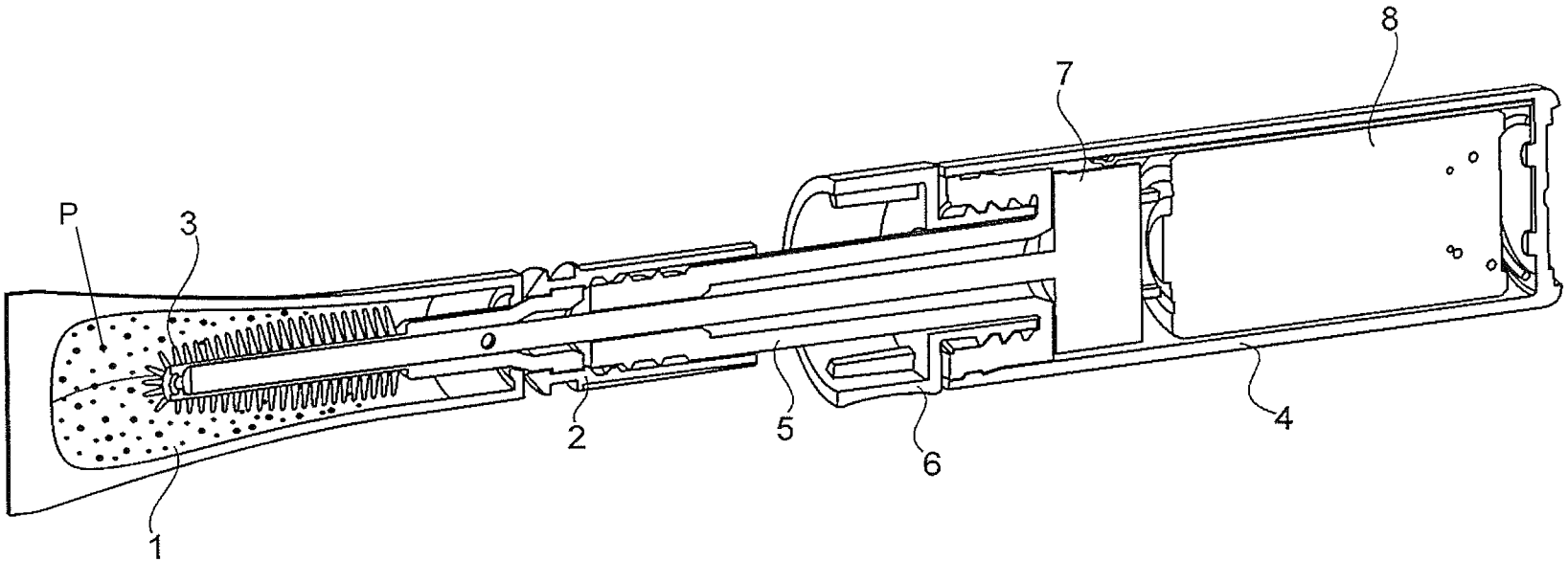
FIG. 1 is a cross sectional view of one embodiment of the present invention.

An overview of one embodiment of the present invention is shown in FIG. 1. One aspect of the invention is a disposable first subassembly that comprises a reservoir (1) that is capable of holding a product (P), an elongated neck (2) that is connected to the reservoir in a detachable manner, and an applicator head (3) that depends from the elongated neck into the reservoir. A portion of the applicator head seals off the product in the reservoir from the ambient atmosphere outside of the first subassembly. From outside the first subassembly, a conduit exists through the elongated neck and into an interior space of the applicator head. Another aspect of the present invention is a reusable second subassembly that is separate from the first subassembly, except at the time of use. The second subassembly comprises a handle (4), an electric circuit housing (5), an electric heating circuit (7), an on-off mechanism (6), and a power source (8). Prior to use, the electric circuit housing and elongated neck are able to form a rigid connection. As a result of forming this connection, a portion of the electric heating circuit is inserted through the elongated neck and into the interior space of the applicator head. After use, the electric circuit housing and elongated neck can be separated, so that the second subassembly can be reused, while the components of the first subassembly are discarded.

The Disposable First Subassembly

One embodiment of a disposable first subassembly of the present invention is shown in FIGS. 2*a*, 2*b*, 3 and 4. The first subassembly comprises a reservoir (1), an elongated neck (2) and an applicator head (3). The first subassembly is considered as "disposable" because after the contents of the reservoir is accessed, it cannot be conveniently resealed, as we will see.

The Reservoir:

The reservoir (1) holds or is able to hold a product (P). The reservoir may typically be cylindrical and fully or partly made of plastic, but this is not required. The reservoir has a top end (1*a*) and a bottom end (1*b*). An orifice (1*c*) located in the top end of the reservoir offers access to the interior (1*d*) of the reservoir. At its top end, the reservoir is connected to an elongated neck (2), which is significantly different from the type of neck usually associated with cosmetic containers.

In various embodiments, the bottom end (1*b*) of the reservoir (1) may be closed before or after filling the reservoir with product, depending on the type of reservoir. For example, if the reservoir is a rigid bottle for holding mascara, then the bottom of the reservoir will be closed when the bottle is molded. In this case, the reservoir is filled through the orifice (1*c*) located in the top end (1*a*) of the reservoir. Alternatively, in some embodiments of the present invention, the bottom end of the reservoir is initially opened for filling product into the reservoir, and subsequently closed. For example, if the reservoir is a flexible tube, it is possible to assemble the first subassembly, and then fill the reservoir through the bottom end of the tube. Thereafter, the bottom end of the tube can be sealed according to known methods, such as heat welding or sonic welding.

Preferably, a wiper element is associated with the orifice (1*c*) of the reservoir (1). In general, the novel configuration of the first subassembly prohibits the use of a conventional separate elastomeric wiper element, which generally covers the inner surface of the neck. In the present invention, a portion of the inner surface of the neck should remain exposed, as we will see. In FIG. 2*b*, one embodiment of a non-conventional wiper element is the down-turned portion (1*e*), which is integrally molded around the perimeter of orifice (1*c*). The relatively smaller size of this wiper element compared to conventional wiper elements may not be a disadvantage, given that the system of the present invention is intended to be used for only one application. The issues of messy product build up and dry-out are not relevant, or not as relevant, as with full size saleable mascara packages.

In other embodiments, the wiper element is long enough to accommodate a substantial length of the working surface of the applicator head. It may be preferable, if the entire working surface can be accommodated inside the wiper. A benefit of this will be explained below.

The Elongated Neck:

At its top end (1*a*), the reservoir (1) is connected to an elongated neck (2), such that the orifice (1*c*) of the reservoir is surrounded by the elongated neck. The elongated neck has a top end (2*a*) and a bottom end (2*b*). The elongated neck of the present invention may generally be longer than a neck commonly found on cosmetic containers, and there are other differences as well. For example, in some embodiments, the elongated neck may have a means of connection on an interior surface. For example, in some embodiments, the elongated neck may have threads (2*d*) formed on its interior surface, rather than on its exterior, as is commonly done. When an interior connection means is used, a wiper element should not interfere with the connection. Another difference is that the connection or articulation (2*c*) between the reservoir and the elongated neck is not intended to be permanent over the life of these components. Preferably, the two components are able to maintain a fluid tight connection prior to use, but are capable of separating under a force that is supplied at the time of use.

Preferably, the reservoir (1) and elongated neck (2) are integrally molded, in which case the reservoir and elongated neck articulate along a surface of joining that is relatively weak and/or brittle compared to the surrounding structure. In this way, when the articulation (2*c*) between the reservoir and elongated neck is subjected to differential twisting and/or shearing and/or flexing, the two components separate. Less preferably, some kind of tool is needed to break the connection. For example, an elongated tool is used to increases leverage against the elongated neck. Or, for example, breaking the connection between reservoir and elongated neck includes a step of scoring around the connection with a with a knife, and then flexing the articulation to fracture it. Or for example, breaking the connection between reservoir and elongated neck includes a step of cutting through the articulation with a knife.

Alternatively, the reservoir (1) and elongated neck (2) may be formed separately and later joined, by any suitable means within the performance requirements herein described. For example, the reservoir and elongated neck may be connected by a cooperating threaded engagement. In this case, the two parts are separated by unscrewing them. As another example, the reservoir and elongated neck may be connected by an interference engagement (i.e. friction fitting, snap fitment) that can be overcome by manual pressure. As another example, the reservoir and elongated neck may be connected by an adhesive engagement, that can be overcome by manual pressure.

When the reservoir (1) and elongated neck (2) are attached, a passage exists through the top end (2*a*) of the elongated neck, through the interior of the elongated neck, out the bottom end (2*b*) of the elongated neck, through the orifice (1*c*) and wiper element (1*e*), and into the reservoir. This passage is sufficiently large to allow an applicator head (3) to pass there-through. Some portion of the elongated neck may be provided with features that cooperate with one or more portions of the applicator head. For example, portions of the elongated neck and applicator head may be able to form a fluid tight seal, so that the contents of the reservoir may not be exposed to ambient conditions.

The Applicator Head:

An applicator head (3) comprises a hollow stem (3*b*), that has a proximal end (3*c*) and a distal end (3*d*). Toward its distal end, the hollow stem supports a working surface (3*a*). A typical form of the working surface may be a mascara brush, but the invention is not so limited.

Figure 2A:
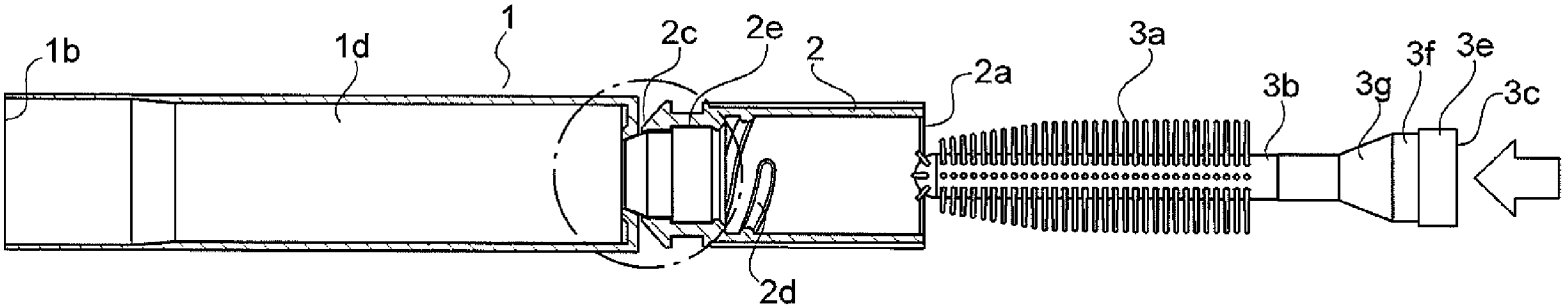
FIG. 2*a* shows one embodiment of the connection between the reservoir and the elongated neck.
Figure 2B:
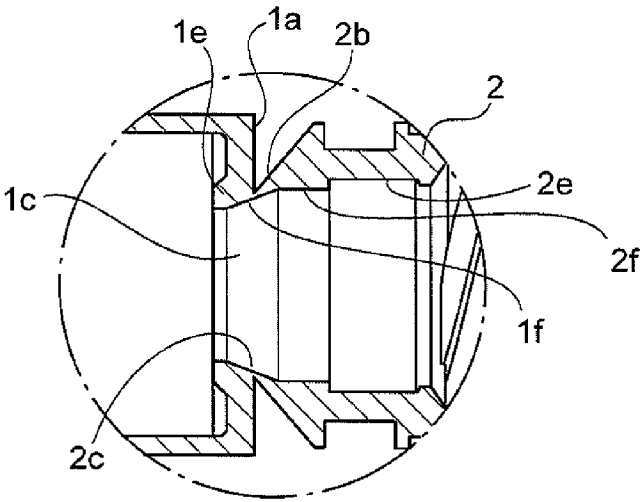
FIG. 2*b* shows the connection in closer detail.
Figure 3:
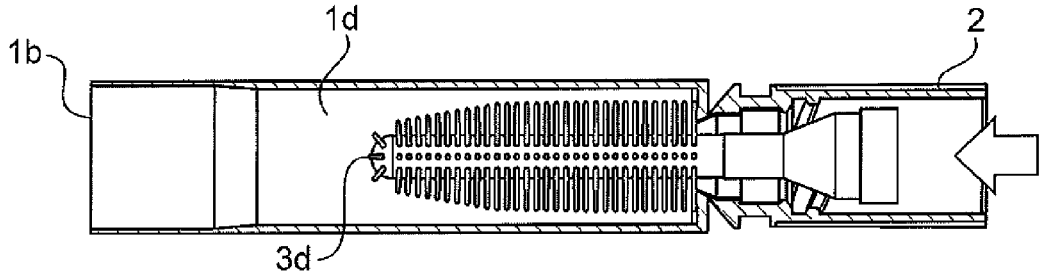
FIG. 3 shows an applicator head being inserted in to the reservoir, through the elongated neck.
Figure 4:
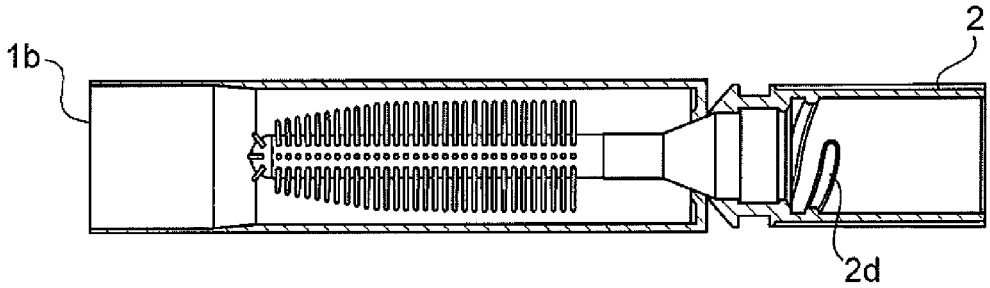
FIG. 4 shows an applicator head fully seated in a reservoir and elongated neck. This arrangement of elements is one embodiment of a first subassembly of the present invention.

As shown in FIGS. 2*a*, 3 and 4, the working surface (3*a*) of the applicator head (3) is able to pass through the top end (2*a*) of the elongated neck (2), through the interior of the elongated neck, through the bottom end (2*b*) of the elongated neck, through the orifice (1*c*) and wiper element (1*e*), and into the reservoir (1). If the reservoir is full of product (P), then the working surface is able to take up product.

The elongated neck (2) forms one or more connections with the applicator head (3), and possibly with the reservoir (1). For example, referring to FIG. 2*a*, near the proximal end (3*c*) of the applicator head, first, second and third portions are provided. Referring now to FIG. 2*b*, first portion (3*e*) fits into recessed portion (2*e*) of the elongated neck; second portion (3*f*) of the applicator head is designed to fit securely into a second portion (2*f*) of the elongated neck; and third portion (3*g*) of the applicator head is design to fit securely into a first portion (10 of the reservoir (1). Preferably, one or more of these connections provide a fluid tight seal. By "fluid tight", we mean a seal that is sufficiently tight to prevent product from leaking out of the reservoir, and sufficiently tight to slow down the degradation of product in the reservoir. Preferably, the fluid tight seal also means that the seal is able to prevent oxidation of a product in the reservoir. By "prevent oxidation, we mean that the product remains in a saleable condition (as a person of ordinary skill in the art would understand "saleable condition") for a period of at least six months, preferably for a period of at least one year, at standard temperature and pressure.

Referring again to FIG. 4, when the applicator head (3) is fully seated into the elongated neck (2), the threads (2*d*) on the interior surface of the elongated neck must be engageable. For example, the hollow stem (3*b*) of the applicator head must not block access to the threads. The hollow stem (3*b*) of the applicator head (3) extends from the interior (2*d*) of the elongated neck (2), to the interior (1*d*) of the reservoir (1). The stem is opened at its proximal end (3*c*), and this opening gives access to the hollow interior that extends between the interior of the elongated neck and the interior of the reservoir. Since the top end (2*a*) of the elongated neck is also opened, the interior of the applicator head is accessible from the outside. The applicator head is able to receive into itself a heat generating portion (7*c*).

Preferably, the product and applicator head are matched for their intended purpose. For example, if the product is a mascara, then the applicator head is preferably of a type known to be used for mascara application, like a brush and/or comb having spaced apart bristles. Or, for example, if the product is a face cream, then a working surface of the applicator head may comprise an extended, smooth surface, contoured for delivering product to portions of the face.

The Reusable Second Subassembly

Figure 6A:
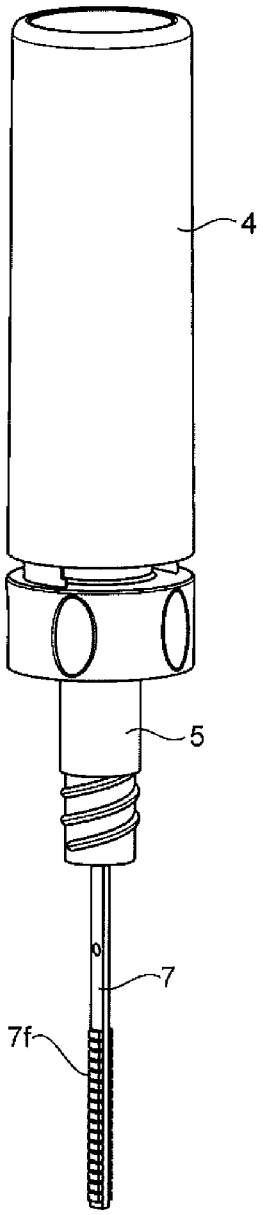
FIGS. 6*a*, 6*b* and 6*c* depict one embodiment of a second subassembly of the present invention.
Figure 6B:
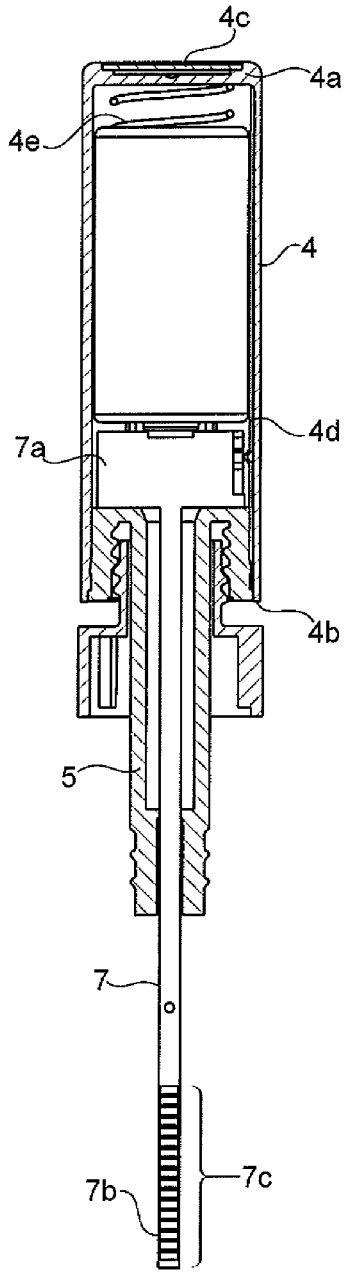
Figure 6C:
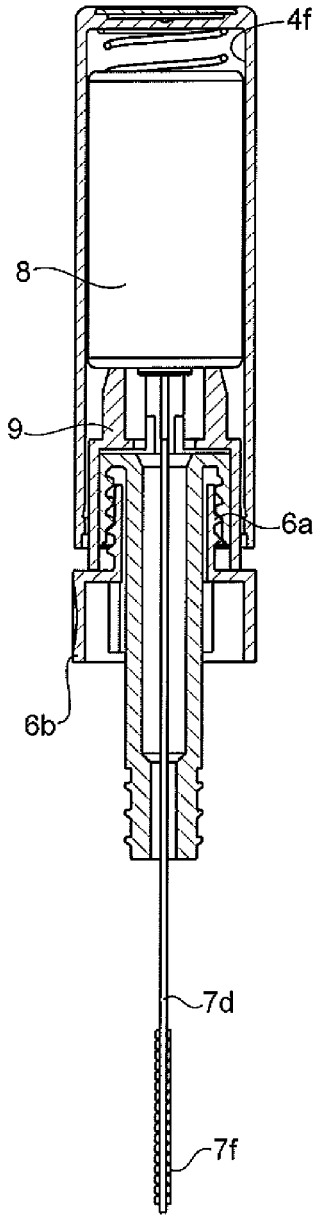

One embodiment of a reusable second subassembly of the present invention is shown in FIGS. 6*a*-6*c*. The second subassembly comprises a handle (4), a electric circuit housing (5), a switchable electric heating circuit (7), and means (6) of engaging the electric heating circuit. The second subassembly is considered as "reusable" because even after a user has disposed of the first subassembly, the second subassembly can be reused with a new first subassembly, as we will see.

The Handle:

In FIG. 6*a*, the handle (4) is shown as a hollow cylindrical structure, but the shape may vary. The handle is large enough to be grasped by a user of personal care products, as is typically done in the field. For example, the handle may be part of a mascara applicator that is from 15 mm to 150 mm in length and from 10 mm to 50 mm in diameter. A closed end (4*a*) of the handle defines the proximal end of the second subassembly. Opposite the closed end of the handle, is an opened end (4*b*). The handle may have a removable cap (4*c*) at its closed end (4*a*). The removable cap offers access to the interior of the handle, access to a battery, for example. The handle will not generally be of the type that is designed to act as a closure for the container, as is commonly done in the art.

The interior of the handle (4) is sufficiently large to accommodate a current source, and a portion of the switchable electric heating circuit. For example, a first metallic lead (4*d*) may be attached to an inner surface (40 of the handle, such that the first lead is able to achieve electrical contact with the heat generating portion. Also, a second metallic lead (4*e*) may be attached to an inner surface of the handle, such that, when a current source is reposed in the handle, the second lead is able to achieve electrical contact with a negative terminal of the current source. The first and second metallic leads of the handle have electrical contact with each other to convey electricity from the heat generating portion to the negative terminal of the current source. Optionally, the second metallic lead may be formed as a spring, which, in a compressed state, urges the current source toward the opened end (4*b*) of the handle.

Fitted to the handle (4), and extending beyond the handle, is a electric circuit housing (5). The electric circuit housing and the handle may be fitted with one or more of: an interference fit, a catch mechanism, adhesive, or any suitable means, depending on the nature of the connection, to be discussed below.

A Electric Circuit Housing:

In its essential features, a electric circuit housing is a hollow, elongated member that is opened near its upper end (5*a*) and lower end (5*b*), to permit a portion of the electric heating circuit to be reposed through it, with portions of the electric heating circuit emerging from both ends of the housing. The housing does not move substantially in relation to the handle (4).

Some embodiments of the present invention have a electric circuit housing (5) as shown in FIGS. 5*a*-5*d*. An upper portion of the electric circuit housing is situated inside the handle (4) such that the housing does not move substantially in relation to the handle. Any suitable means of securing the electric circuit housing against unwanted motion relative to the handle may be used. For example, a portion of the housing may be shaped complimentarily to an interior portion of the handle. For example, in the figures, the upper end (5*a*) of the housing is formed as a roughly cylindrical portion that fits snugly within a cylindrical interior of the handle. This relationship may best be seen in FIG. 6*b*. Detents (5*c*) in the housing for forming a snap fitment to handle, may also be provided to further secure the housing to the handle.

In some embodiments of the invention, the lower end (5*b*) of the electric circuit housing (5) is able to form a rigid connection to the elongated neck (2). Referring again to FIG. 4, when the applicator head (3) is fully seated into the elongated neck, then a connection means on the interior surface of the elongated neck is engageable. For example, the lower end of the electric circuit housing may be provided with threads (5*d*) that are designed to engage a set of threads (2*d*), provided on an interior surface of the elongated neck. In an alternate embodiment, the connection between the electric circuit housing and the elongated neck may require less than a full rotation. For example, the connection may implemented as a quarter-turn, bayonet style or lug style locking mechanism. The limited amount of rotation may be preferable to prevent damage to a heat generating portion or to the lower portion of a printed circuit board, as we will see.

Regardless of manner of connection, once the electric circuit housing (5) and elongated neck (2) are connected, the handle-housing combination can be used for leverage to break the connection or articulation (2*c*) between the reservoir (1) and elongated neck. Thereafter, the elongated neck (2), the applicator head (3), the handle (4), and the circuit housing (5) are able to behave as one, substantially rigid piece. Thus, the applicator head can be raised out of the reservoir.

Figure 5D:
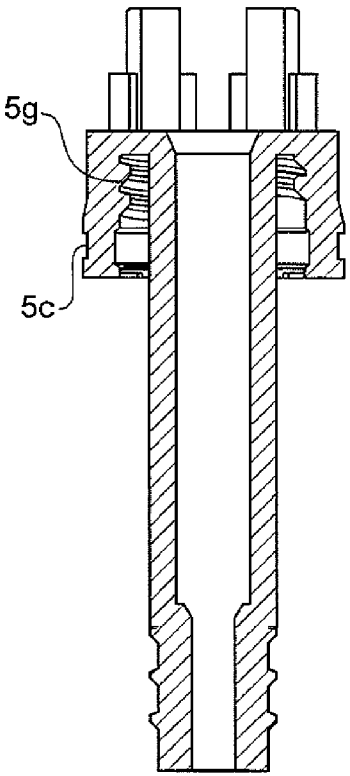
FIGS. 5*c* and 5*d* depict the same stem, but rotated 90° relative to FIGS. 5*a* and 5*b*.
Figure 5C:
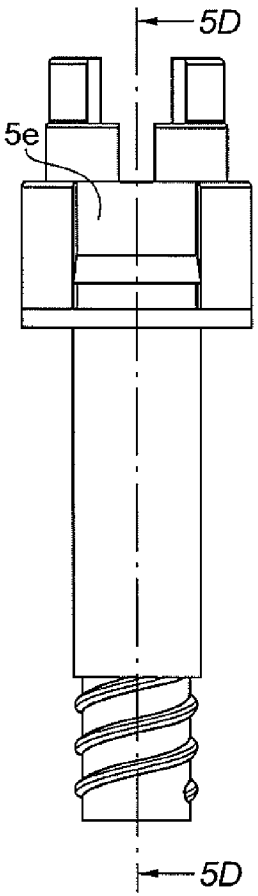
Figure 5B:
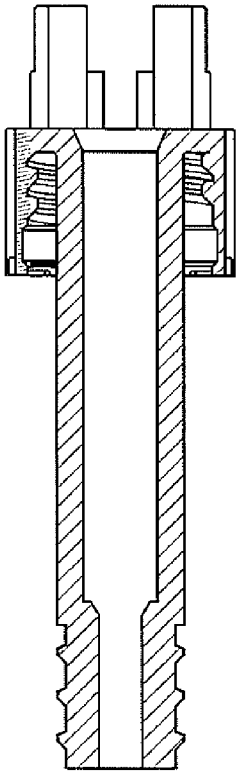
FIGS. 5*a* and 5*b* depict one embodiment of the stem (5).
Figure 5A:
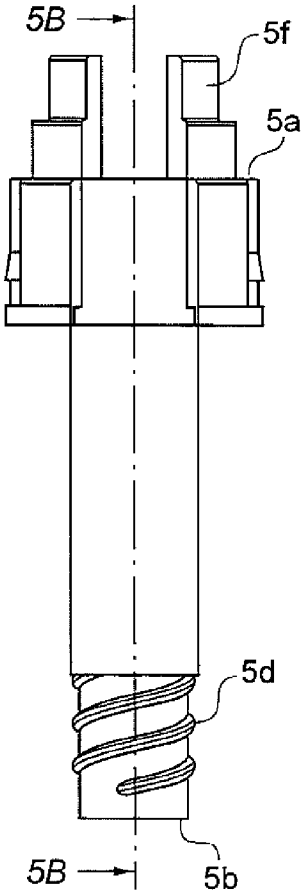

Referring to FIGS. 5*a* and 5*c*, in still other embodiments of the invention, at least one vertical groove (5*e*) is provided near the upper end (5*a*) of the electric circuit housing (5), while one or more vertical extensions (5*f*) rise above the upper end. In still other embodiments, the upper end (5*a*) of the housing is formed as a roughly cylindrical portion that is partly hollow and opened near the bottom of the cylindrical portion. In this way, threads (5*g*), disposed on the interior of the cylindrical portion may be engaged. The purpose of these optional features will be explained below.

A Switchable Electric Heating Circuit:

The system for sampling a heated product further comprises an interruptible or switchable electric heating circuit. In general, when a switch in the circuit is closed, current flows to a heat generating portion, and this defines the heat generating portion as "on". When this switch is opened, current is not flowing to the heat generating portion, and this defines the heat generating portion as "off". When the heating circuit is closed, current flows from the positive terminal of a power source (8), through the electric circuit housing (5), then to a heat generating portion that is capable of being located inside the applicator head (3), back through the electric circuit housing, along one or more leads to a negative terminal of the power source. In general, the electrical path may comprise various electric components that add functionality and/or efficiency to the circuit.

Referring to FIGS. 6*b* and 6*c*, one embodiment of a switchable electric heating circuit comprises a printed circuit board (PCB) (7), a battery (8), and one or more electrical conductors that are not on the PCB. When a PCB is used, then the electric circuit housing (5) is a housing for the printed circuit board, and may be referred to as the PCB housing.

The printed circuit board (7) is an elongated structure that passes through the PCB housing (5) such that portions of the PCB emerge from either end of the PCB housing. An enlarged portion (7*a*) of the PCB is situated inside the handle (4), near a battery. A lower portion (7*b*) of the printed circuit board supports a heat generating portion (7*c*). The heat generating portion must be able to fit into the hollow stem (3*b*) of the applicator head (3). The bulk of the electronic circuitry is carried on the printed circuit board. The printed circuit board comprises a substrate (7*d*) that is non-conductive to electricity under the conditions of normal or expected use. Suitable substrate materials include, but are not limited to, epoxy resin, glass epoxy, Bakelite (a thermosetting phenol formaldehyde resin), and fiberglass. The substrate may be about 0.25 to 5.0 mm thick, preferably 0.5 to 3 mm, more preferably, 0.75 to 1.5 mm thick. Portions of one or both sides of the substrate may be covered with a layer of copper, for example, about 35 μm thick. The substrate supports one or more heat generating portions, electronic components and conductive elements. Among the conductive elements supported by the PCB, are electrical leads and/or terminals that that are effective to connect the PCB to a battery.

As an example, a printed circuit board (7) will be described that supports various elements in a preferred (but not exclusive) arrangement. The PCB itself may have any shape or dimensions that are convenient to manufacture and assemble into the PCB housing (5), with the requirement that the PCB is able to extend from the electric current source (8), to a distance beyond the distal end of the PCB housing. This distance depends on the overall length and design of the system. In general, the PCB cannot be so long that it would bottom out in the applicator head before the PCB housing and elongated neck form a rigid connection.

Figure 7:
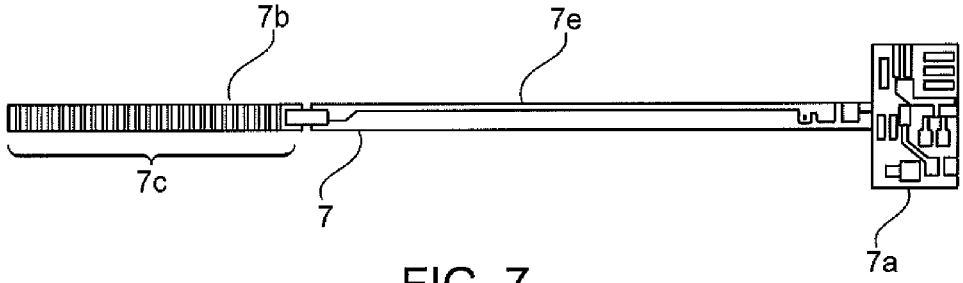
FIG. 7 is a representation of a printed circuit board with heat generating portion.
Figure 8:
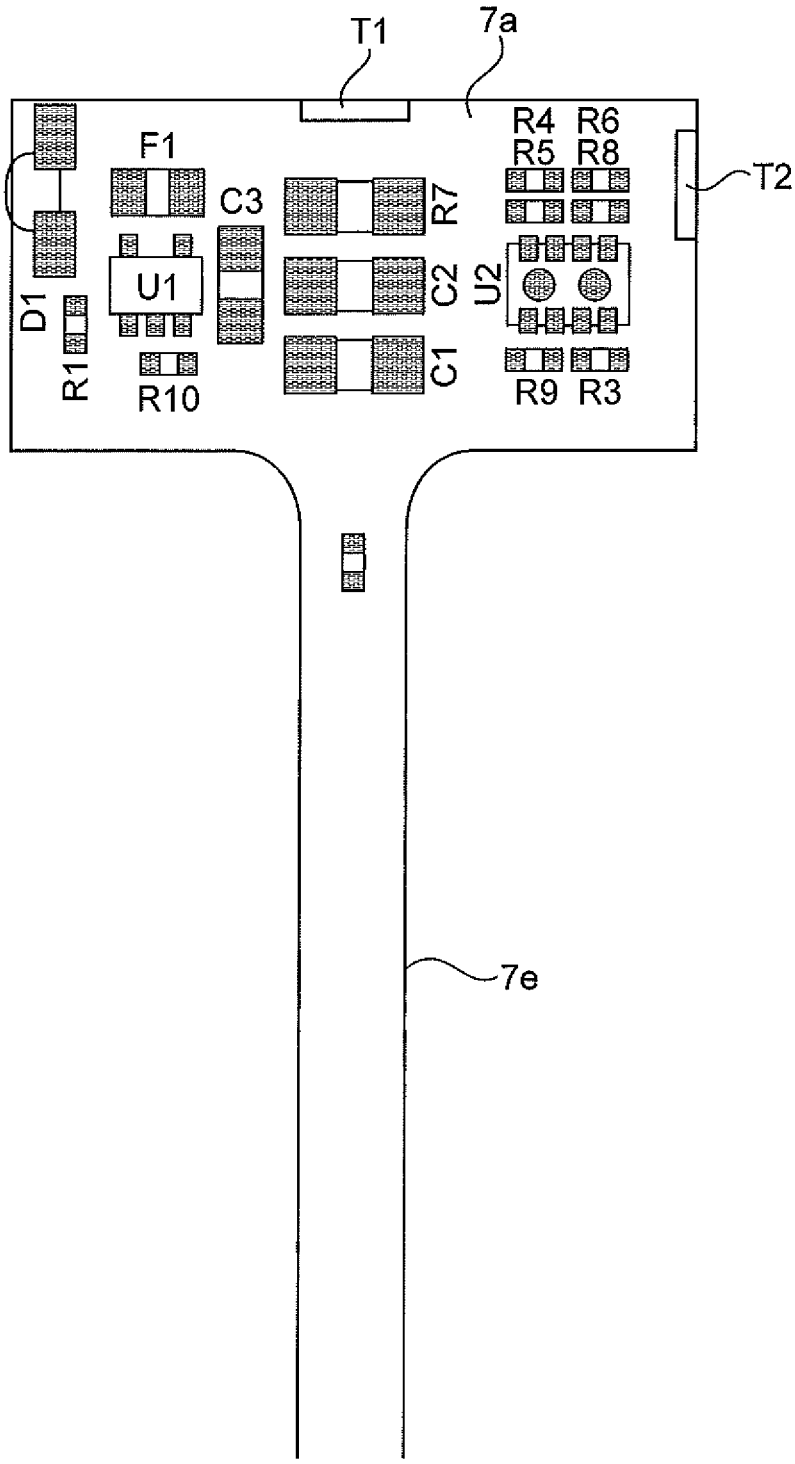
FIG. 8 shows one possible electronic circuit laid out on a printed circuit board.

Referring to FIGS. 7 and 8, all or most of the electronic elements or components except the resistive heating element(s) (7*c*) may be located on the enlarged portion (7*a*) of the printed circuit board, near the upper end of the board. The largest lateral dimension of the enlarged portion of the PCB must be less than an interior dimension of that part of the handle (4) in which it resides. A relatively narrow, elongated section (7*e*) of the PCB extends from the enlarged portion, through the PCB housing (5), and emerges from the lower end of the PCB housing. A portion (7*b*) of the PCB that emerges from the lower end of the PCB housing, holds the heat generating portion (7*c*). Preferably, none of the heat generating portion is inside the PCB housing, as this would tend to reduce the heating efficiency of the system.

Figure 9:
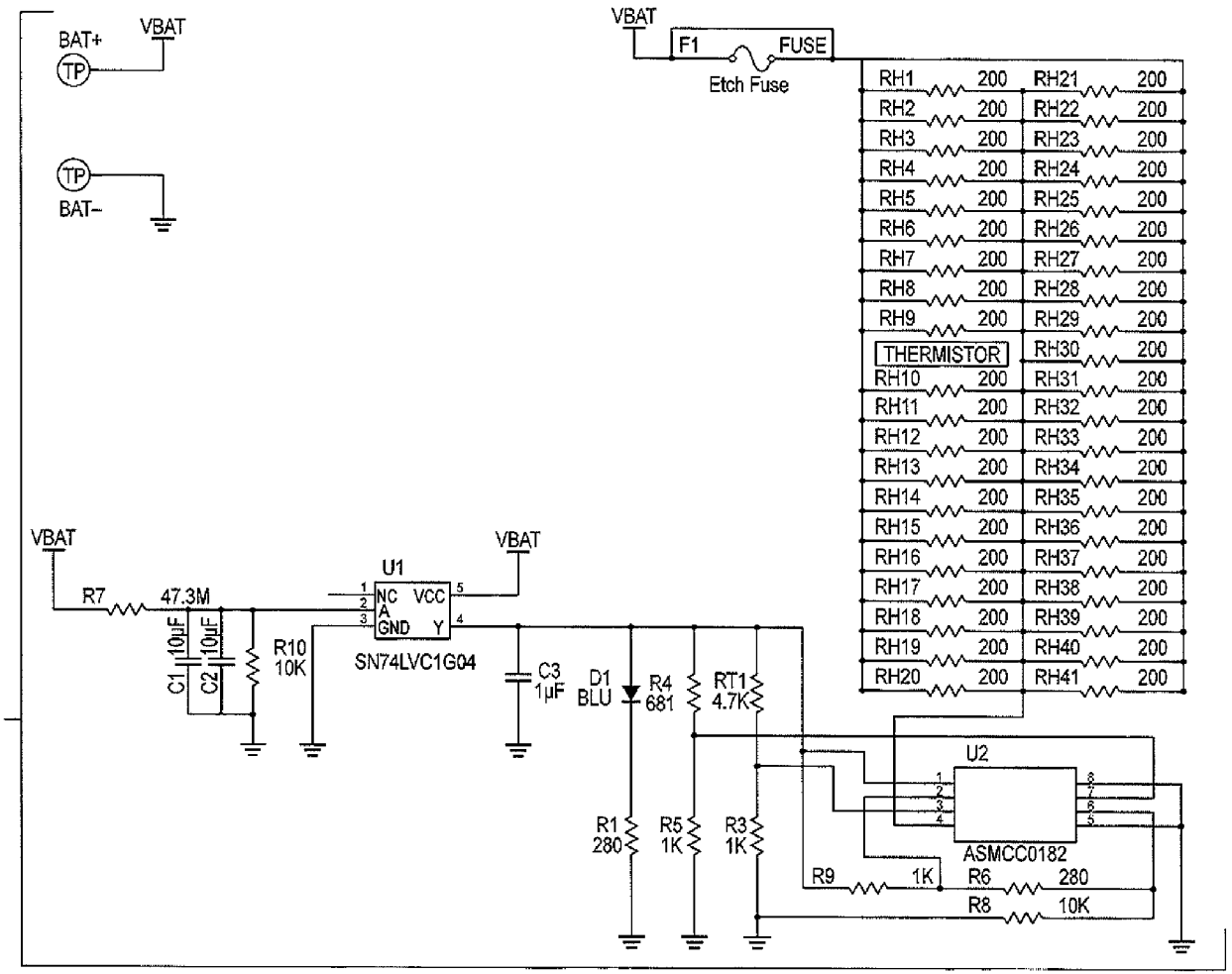
FIG. 9 is a schematic of one possible electronic circuit used in the present invention.

FIG. 9 shows one possible electronic circuit useful in the present invention, which could be laid out on a printed circuit board (7). FIG. 8 shows one possible layout of electronic elements on the PCB. Electric current from a power source (8), (a rechargeable battery, for example) enters the printed circuit board at a PCB terminal (T1). This terminal may occupy an edge of an enlarged portion (7*a*) of the PCB. In a preferred embodiment, the positive terminal of the battery (8) may alternately occupy at least one "on" position and at least one "off" position, according to the positioning of a switch. That is, movement of the switch may physically move the battery. In an "on" position, the positive terminal of the battery directly contacts terminal T1 of the PCB. In the "off" position, the positive terminal of the battery has no physical contact with a terminal of the PCB. This embodiment has the advantage that it does not require additional conductors between the positive terminal of the battery and circuit board. Alternate embodiments for the functioning of switch are possible, according to the well known operation of switches.

Resistor R7 and parallel capacitors C1 and C2, interact with a power inverter U1, to automatically shut off current to the heat generating portion (7*c*) when the capacitors are full. The capacitors may be, for example, ceramic chip capacitors, fastened to or otherwise associated with the PCB. The rated capacitances are chosen to control the length of time from when the switchable circuit is first closed, to when the switchable circuit (and the heat generating portion) will automatically turn off. This overhead timer, automatic shut off feature is optional, and prevents the battery from running down if the user fails to turn off the circuit. Since a user needs time to apply the product after it has been heated, the circuit may be designed to turn off the heat generating portion some amount of time after the heat generating portion has reached a predetermined temperature. This length of time can be chosen according to need, but may typically be from about 2 to 5 minutes. Furthermore, depending on the level of sophistication employed, an overhead timer such as the capacitor-based one shown in FIG. 8, may require a reset period, following an automatic shut off, in which the heating elements cannot be activated (i.e. cannot be "turned on"). The reset time, which may be several seconds, allows the capacitors to discharge.

RT1 is an NTC thermistor. Preferably, the NTC thermistor is physically located in close proximity to the heating elements (7*c*). For example, in the circuit diagram of FIG. 9, a space is shown between heating elements RH9 and RH10. The NTC thermistor may be located in that space, or any space where it could detect slight variations in the ambient temperature of the space surrounding the heating elements. The NTC thermistor and a fixed value resistor R3, are configured as a voltage divider circuit that creates a voltage level that is proportional to and/or varies with the temperature of the heating elements. That voltage level is monitored by an operational amplifier and is passed to the operational amplifier at the inverting input (pin 3 of U2). A threshold reference voltage is produced by another voltage divider circuit at R4 and R5, and this voltage is connected to the non-inverting input (pin 7 of U2) of the operational amplifier. In this way, the operational amplifier is used as a voltage comparator. When the output voltage of the voltage divider circuit that includes the negative temperature thermistor crosses the reference voltage (either rising above or falling below), then the output of the operational amplifier (pin 2 on U2) changes state. The output of the op amp is passed to an N-channel MOSFET switch (at pin 6 of U2), and is used to control the state of MOSFET switch. When the switch is closed, current flows from the switch (at pin 4 of U2) to the resistive heating elements (7*c*). When the switch is opened, current cannot flow to the resistive heating elements. An edge of the enlarged portion (7*a*) of the PCB (7) is provided with a second terminal (T2), which leads to the negative battery terminal through the metal strip (4*d*) and coil/spring (4*e*, see FIGS. 6*b*, 6*c*).

The circuit may further include noise reducing components, such as capacitor C3, an on/off indicator, such as LED D1, and multiple fused portions, such as at F1. Also, more than one thermistor can be used to increase the temperature monitoring capabilities.

The circuit, as described, includes a system that actively measures the output temperature and adjusts itself to meet a desired temperature. A system for sampling a heated product that includes this circuit can stay on for an extended period, holding a desired temperature, with no concern for overheating. Also, through the use of an automatic shut off and through the monitoring of the temperature of the heating elements, power utilization is significantly reduced. In this regard, the present invention may provide a commercially feasible, partially disposable, sanitary system for sampling a heated product, with a level of precision and reliability described herein.

The circuit may further include a system for monitoring and maintaining an output voltage of the power source. For example, batteries are rated with a nominal voltage, such 3 volts, but there is some variability from battery to battery, and from use to use of the same battery. An optional system may be included that monitors and adjusts as needed, the battery voltage, to maintain a tighter tolerance of voltage than the battery normally supplies. One benefit of such a system is improved consistency in applicator performance and improved predictability in battery lifetime.

The circuit described above utilizes a printed circuit board (7). The use of a printed circuit board may result in a cost savings, and error reduction in manufacture. Thus, the circuit herein described may provide a truly effective, commercially feasible, aesthetically acceptable, battery powered system for sampling a heated product, with the performance, reliability and convenience herein described, and may well achieve a cost savings and error reduction in manufacturing, compared to devices using more conventional wiring methods. In contrast, without a circuit board as herein described, the creation of a system for sampling a heated product would be considerably more difficult, more expensive, and less reliable. For the personal care market, creating a system for sampling a heated product without a printed circuit board as herein described, may make the cost of manufacture prohibitive, and the performance of lower quality, which is not what you want when a potential customer is sampling a product.

One or more heat generating portions (7*c*) are supported by the lower portion (7*b*) of the printed circuit board. Typically, a system for sampling a heated product according to the present invention may have only one heat generating portion. Preferably, no part of the heat generating portion extends into PCB housing (5), as heating inside the PCB housing wastes energy and decreases efficiency.

The heat generating portion (7*c*) may comprise a continuous resistive wire loop or coil. While straightforward, this type of heat generating portion does no offer the performance and energy efficiency of more advanced options, such as an array of discrete heating elements. Therefore, preferably, a system for sampling a heated product according to the present invention includes a plurality of individual, discrete resistive heating elements (7*f*), supported on the lower portion (7*b*) of the printed circuit board (7), outside of the PCB housing (5).

A preferred embodiment of the discrete resistive heating elements (7*f*) is a bank of fixed value resistors electronically arranged in series, parallel, or any combination thereof, and physically situated in two rows, one on either side of the PCB (7). The number of resistors and their rated resistance is governed, in part, by the requirements of heat generation of the circuit. In one embodiment, 41 discrete resistors of 5 ohms are uniformly spaced, 20 on one side of the PCB, and 21 on the other side. In another embodiment, 23 6-ohm resistors are used, 11 on one side of the PCB, 12 on the other. In still another embodiment, forty-one 3-ohm resistors are used, 20 on one side, 21 on the other. The side with 1 fewer resistor leaves a space for a thermistor. Typically, a system for sampling a heated product according to the present invention might use 10 to 60 individual resistive elements having rated resistances from 1 to 10 ohms. However, these ranges may be exceeded as the situation demands. Typically, the overall resistance of all the heating elements might range from 1 to 10 ohms. However, this range may be exceeded as the situation demands.

One preferred type of resistive heating element is a metal oxide thick film resistor. These are available in more than one form. One preferred form is a chip resistor, which is thick film resistor reposed on a solid ceramic substrate and provided with electrical contacts and protective coatings. Geometrically, each chip may be approximately a solid rectangle. Such heating elements are commercially available, in a range of sizes. For example, KOA Speer Electronics, Inc (Bradford, Pa.) offers general purpose thick film chip resistors, the largest dimension of which is on the order of 0.5 mm or less. By using resistors whose largest dimension is about 2.0 mm or less, better, in one embodiment 1.0 mm or less, even better, in another embodiment 0.5 m or less, the resistors can easily be arranged along the printed circuit board (7), outside of the PCB housing (5).

Typically, chip resistors may be attached to the PCB by known methods. A more preferred form of metal oxide thick film resistor, is available as a silk screened deposit. Without a housing, such as the chip resistor, the metal oxide film is deposited directly onto the printed circuit board, using printing techniques. This is more efficient and flexible from a manufacturing point of view than welding chip resistors. The metal oxide film may be deposited on the PCB as one continuous heating element, or it may be printed as individual dots. Various metal oxides may be used in thick film resistor manufacture. One preferred material is ruthenium oxide ($RuO_2$). The individual dots may be printed as small as about 2.0 mm or less, more preferably 1.0 mm or less, most preferably 0.5 mm or less, and their thickness may vary. In fact, by controlling the size of the dots, one may alter the resistance of each dot. Also, the resistance of the thick film resistor, whether in a chip resistor or silk screened form, may also be controlled by additives in the metal oxide film. Typically, chip resistors and silk screened metal oxide dots of the type described herein, may have a rated resistance of 1 to 10 ohms.

A printed circuit board that carries silk screened thick film resistors or chip resistors, is less bulky than one that carries prior art heating elements such as a wire coil. Less bulky electronics means that the flux of heat into the product is increased, and less heat is wasted.

In general, gaps between the heat generating portion (7*c*) and the applicator head (3) decrease heat transfer efficiency. Therefore, it is preferable if there are as few gaps as possible between the heat generating portion and the inner surface of the applicator head. Therefore, it is preferable if the applicator head fits snugly over the heat generating portion. This will improve the efficiency of heat transfer through the applicator head, from the inside, going out. In one embodiment of the present invention, the inner surface of the hollow stem (3*b*) of the applicator head is in direct contact with a heat generating portion. This arrangement is effective, but still may leave air-filled gaps underneath the applicator head. The transfer of heat through the applicator head and into a product in the reservoir (1) may be diminished by these air-filled gaps. Thus, it is most preferable if there are no such gaps. In another embodiment of the present invention, the heat generating portion is encased in a cylindrical shell of heat transfer material. Making the shell includes embedding the heating elements in a continuous mass of a heat transfer material. The material may be applied by dipping the heat generating portion into heat transfer material that is in a softened state. When the material hardens, there may be substantially no air gaps within the heat generating portion. In at least some embodiments, as long as the heat transfer material improves the rate of heat transfer from the heating elements into the product, then this embodiment is preferred for many applications. The heat transfer material can form a semi-hardened or hardened cylindrical shell over the heat generating portion. The cylindrical shell must fit into the hollow stem (2*b*) of the applicator head (2). Preferably, the cylindrical shell fits snuggly into the hollow stem, to minimize the amount of air in between the cylindrical shell and the hollow stem. Examples of useful materials for the cylindrical shell of heat transfer material include one or more thermally conductive adhesives, one or more thermally conductive encapsulating epoxies or a combination of these. An example of a thermally conductive adhesive is Dow Corning® 1-4173 (treated aluminum oxide and dimethyl, methylhydrogen siloxane; thermal conductivity=1.9 W/m·K; shore hardness 92A). An example of a thermally conductive encapsulating epoxy is 832-TC (a combination of alumina and a reaction product of epichlorohydrin and Biphenyl F; available from MG Chemicals, Burlington, Ontario; thermal conductivity=0.682 W/m·K; Shore hardness 82D). For the heat transfer material, a higher thermal conductivity is preferred over a lower thermal conductivity.

Some embodiments of the present invention further comprise a source (8) of electric current, preferably a DC power supply. The current source is housed within the handle (4), which is sufficiently large to accommodate the current source. The current source has at least one positive terminal and at least one negative terminal. One or more of the power source terminals may directly contact a conductive element on the printed circuit board (7), or one or more electrical leads may intervene, like first metallic lead (4*d*) or spring (4*e*).

In a system for sampling a heated product of the present invention, each time the heating circuit is activated (or "turned on"), it is preferable if the power source (8) is able to provide, by itself, sufficient energy to raise the temperature of a product, as described herein. In a preferred embodiment, the DC power supply includes one or more batteries, more preferably exactly one battery. Many types of battery may be used, as long as the battery can deliver the requisite power to achieve defined performance levels. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches. Furthermore, it is preferable if the battery is disposable in the ordinary household waste stream. Therefore, batteries which, by law, must be separated from the normal household waste stream for disposal (such as batteries containing mercury) are less preferred.

Optionally, the power source may be replaceable or rechargeable. For example, the handle (4) may have a removable cap (4*c*). The removable cap offers access to a battery (8) in the handle. Alternatively, or in addition to being replaceable, the battery may be of the rechargeable type. To that end, either the battery can be removed from the handle, as just described, or the exterior of the system can be provided with electric leads to the battery, such that the system can be reposed in a charging base, so that power from the base is transmitted to and stored in the battery.

The On/Off Mechanism:

A system for sampling a heated product according to the present invention may comprise one or more features that permit a user to engage the heating circuit. Preferably, a system according to the present invention comprises at least one mechanism that is capable of alternately interrupting and re-establishing the flow of electricity between the power source (8) and the heating elements (7*c*). In some embodiments, an on-off mechanism has at least two positions. In at least one of the positions the mechanism effects electrical contact between the heat generating portion and the power source, and in at least one of the positions the mechanism interrupts electrical contact between the heat generating portion and the power source.

In one possible embodiment, at least one on/off mechanism is accessible from the outside the system, where it can be engaged, either directly or indirectly, by a user. This type of on-off mechanism is "manual", requiring the user to directly engage the mechanism, which is something that a user does not have to do with a conventional, non-heating dispenser. Some on-off mechanisms must become part of the electric circuit to work. The details of this type of on-off mechanism are well known in the electrical arts. Some non-limiting examples include: toggle switches, rocker switches, sliders, buttons, touch activation surfaces, magnetic switches and light activated switches. Also, multi-position switches or slider switches may be useful, if the heating elements are capable of multiple heating output levels. In general, a manual on-off mechanism may be located anywhere that makes it accessible (directly or indirectly) from the outside the dispenser.

Figure 10A:
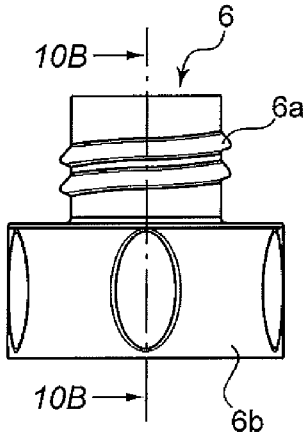
FIGS. 10*a* and 10*b* depict a rotating collar, which acts as an on-off mechanism.
Figure 10B:
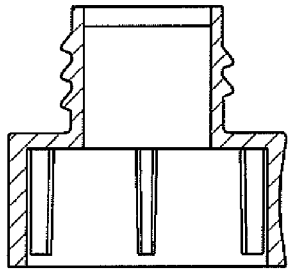

In the some embodiments of the invention, (see FIGS. 10*a* and 10*b*, for example), the on-off mechanism is formed as a rotating collar (6) comprised of a threaded neck (6*a*) sitting on a cylindrical shell (6*b*). The threaded neck is designed to screw into the threaded interior of the cylindrical portion of the electric circuit housing (5). To achieve this, the lower portion of the electric circuit housing must pass through the rotating collar, as shown, so that the rotating collar and electric circuit housing are co-axial. In this arrangement, by rotating the collar with respect to the handle (4), the rotating collar is able to move toward and away from the handle. In conjunction with the rotating collar, one or more tabs (9) are provided, as shown in FIG. 6*c*. A lower end of each tab contacts the rotating collar and an upper end contacts the battery (8). Each tab passes from outside the handle to the inside of the handle through a vertical groove (5*e*) in the electric circuit housing. When the rotating collar is screwed toward the handle, the tabs move further into the handle. When this happens, contact between the tabs and the battery forces the battery further up the handle, away from contact with the printed circuit board (7), and compressing the spring (4*e*). Thus, by screwing the rotating collar into the handle, the electric heating circuit is opened, and no current flows to the heat generating portion (7*c*). Furthermore, when the rotating collar is screwed away from the handle, the tabs move further out of the handle. When this happens, the spring expands, forcing the battery toward the printed circuit board, until a positive terminal of the battery contacts an electrical lead on the printed circuit board. Thus, by screwing the rotating collar out of the handle, the electric heating circuit is closed, and current flows to the heat generating portion.

In the embodiment just described, the spring (4*e*) serves a dual purpose. A first purpose of the spring, as noted earlier, is to serve as an electrical lead to the negative terminal of the battery (8). A second purpose, is to urge the battery from a first position to a second position. In the first position, when the spring is more compressed against the handle (4), the battery's positive terminal is not making electrical contact with the printed circuit board. In this arrangement, current cannot flow to the heat generating portion (7*c*). In the second position, when the spring is more expanded, the battery's positive terminal is making electrical contact with the printed circuit board, in a way that allows current to flow to the heat generating portion. In a preferred embodiment, the enlarged portion (7*a*) of the printed circuit board comprises an electric lead (T1, in FIG. 8) that is able to contact a positive terminal of the battery, when the battery is in its second position. For example, the electrical lead (T1) is near a proximal edge of the enlarged portion, where a positive terminal of the battery may contact it.

Referring to FIG. 5*c*, in still other embodiments of the invention, one or more vertical extensions (5*f*) rise above the upper end (5*a*) of the electric circuit housing. These extensions may be used to limit the pressure that the spring (4*e*) and the battery (8) exert on the enlarged portion (7*a*) of the printed circuit board (7).

Performance Factors

Various parameters of the system for sampling a heated product will affect the amount of heat required to raise the temperature of a product in the reservoir (1) and/or the amount of time required to do it. For example, in general the more product in the reservoir, the more heat will be needed to raise the temperature of the product to a product application temperature, in a given amount of time. Also, for example, given a specific rate of heat generation, a thicker applicator head (3) means more time will be needed to raise the temperature of the product in the reservoir. To increase the rate of heat transfer through the applicator head, and to reduce the amount of heat lost, it may be preferable to make the hollow stem (3*b*) of applicator head as thin as possible, considering the limitations of manufacture in the specific material used. Preferably, the thickness of the wall of the applicator head is less than 1.0 mm, more preferably less than 0.8 mm, even more preferably less than 0.6 mm and most preferably less than 0.4 mm. Of course, since heat passes through the applicator head, the amount of heat and/or the length of time needed to raise the temperature of a product disposed in the reservoir also depends on the thermal conductivity of the material(s). So, in general, to decrease the amount of time required to raise the temperature of the product, one might increase the rate of heat generation, decrease the mass being in heated (thinner applicator head), and/or increase the thermal conductivity of the applicator head.

Systems for sampling heated products, according to the present invention, are configured to raise the temperature of a dose of product from an ambient temperature to a product application temperature. That temperature may be adjusted to market demands. For example, the product application temperature may be 40° C. or greater, or 50° C. or greater, or 60° C. or greater, and so on, as the situation dictates. Immediately prior to application, a system for sampling a product according to the present invention is able to heat an amount of product from an ambient temperature to a product application temperature, in 60 seconds or less, preferably 30 seconds or less, more preferably 15 seconds or less, and most preferably 5 seconds or less. As a result of heating, some characteristic of the dispensed product is enhanced or improved. The enhanced or improved characteristic may be for example a reduction in viscosity, activation of an active ingredient, a threading effect in a mascara product, a longer shelf life, a feeling of warmth experienced by the consumer, enhanced penetration of the product into the skin of a user, release of an encapsulated ingredient, or any other change that benefits the user.

Some Optional Features

In one alternative embodiment, the heating elements are automatically switched on and off (i.e. activated and deactivated). "Automatically switched" means that the heating elements are turned on or off as a result of normal use of the sample system. For example, when the PCB housing is being attached to the elongated neck (2), the heating generating portion may be activated, and then deactivated as the PCB housing is being detached from the elongated neck. The advantage here is that the there is no chance that the heating generating portion will be left on when it is not inserted in an applicator head.

In another embodiment, there may be more than one on-off mechanism in a single heating dispenser. A first on-off mechanism could be a manual on-off mechanism, such as described above, and a second on-off mechanism could be an automatic switch. These could be wired to operate as a so-called "three-way" switch, giving a user the option of overriding the automatic switch.

The present invention is configured to raise the temperature of a dose of product from an ambient temperature to a product application temperature in a defined amount of time. Since the consumer may have to wait for heating to occur, the dispenser may be provided with an indication that the product has reached application temperature, and application can begin. For example, a portion of the exterior surface of the reservoir (1) may be fashioned from a material that reacts to changes in temperature, i.e. by changing color. In this case, the "thermochromic" surface should be sufficiently close to the heat generating portion so that a visible color change occurs within a several seconds of the product in the chamber reaching application temperature; i.e. no more than 10 seconds, preferably, no more than 5 seconds, more preferably no more than 3 seconds. Alternatively, the electric circuit may include an LED that lights up when the product in the reservoir has reached an application temperature. The system may also have an LED that lights up as soon as the heating circuit is closed, to tell a user that the heating circuit is on.

The second subassembly may comprises electric circuits other than the heating circuit. These may offer a user other functionality or convenience. For example, electric circuits may be provided for a vibration system, a lighting system, a sound system, etc.

Products for Use with a System for Sampling a Product

A non-exhaustive list of product types that may benefit from being sampled with a system according to the present invention includes: products heated for aesthetic reasons (i.e. shave cream); those heated to activate an ingredient; those heated to alter the rheology of the product; those heated to sterilize the product; those heated to release an encapsulated ingredient, as by melting a gelatin capsule, for example. Particularly preferred products are eyelash products, such as mascara. Forms of product include creams, lotions, serums, gels, liquids, pastes, powders or any product that may be applied with a handheld applicator of the types known to be used in the cosmetic and personal care fields.

As described herein, the reservoir (1) of the system is designed to hold a finished product to be used at a point of sale. A "finished product" is one that could be used even without heating, or one that requires only heating prior to use. Therefore, products that require additional preparation beyond heating, may not be suitable or may be less suitable for the present invention. For example, a pre-shave foam mixture that must be combined with a liquid propellant outside of the reservoir (2), would not be suitable for use in the present invention. An exception to this includes products that can be constituted by shaking the reservoir prior to use. In general, the products may be mixtures, suspensions, emulsions, dispersions or colloids. Particularly preferred products are those that could be exploited by having some structural or dynamic property temporarily altered by heating. For example, heating may temporarily reduce the viscosity of a mascara product to improve application and make application easier, whereas, after cooling, the viscosity of the mascara may return to near pre-heating levels.

In general, as a material is heated, the change in temperature varies inversely with the heat capacity of the material. Therefore, considering the time and energy required to heat product contained in the reservoir (1), products having a smaller heat capacity may be thought of as more efficient than products having a larger heat capacity. Among cosmetic liquids, water has one of the higher heat capacities. Therefore, in general a personal care composition with less water may heat more efficiently than one with more water, all else being the same. For some applications then, it may be preferable to use a product that has less than 50% water, more preferably less than 25% water, and more preferably still less than 10% water and most preferably, an anhydrous product. Of course, not every type of product can be implemented as an anhydrous or low water product, and personal care compositions having 50% or more of water may still be suitable for use in a system according to the present invention.

Offered as a Saleable Set

Although, especially effective as a means for sampling products at a point of sale (i.e. a cosmetics counter), the system for sampling a heated product as described herein may be provided as a saleable item, for example, as a makeup set. When this is done, it may be preferable to offer for sale a set in an outer package, where the set comprises a second subassembly as described herein, with one or more first subassemblies.

Optionally, when there is more than one first subassembly in the outer package, all the reservoirs do not contain the same product. For example, an outer package may hold one second subassembly, and three first subassemblies, the three reservoirs containing mascara products of three different colors.

Optionally, the outer package may also contain instructions for use of the dispenser, or that directs a user to instructions for use. For example, instructions for use may be printed on a substrate that is included in the outer packaging. Alternatively, the outer packaging may direct the user to a website where instructions for use can be viewed on a monitor. Instructions for use may include some or all of the following: how to assemble the second subassembly to the first subassembly; how to break the articulation between the reservoir and the elongated neck; how to turn on the heating elements, how long to wait for product to heat before applying, how to turn off the heating elements, how to access and change the battery (8), how to detach an applicator head from the second subassembly, how to dispose of any part of the system. Optionally, the outer packaging may include one or more batteries intended to power the heating generating portion of the second subassembly.

Methods of Use

Figure 11:
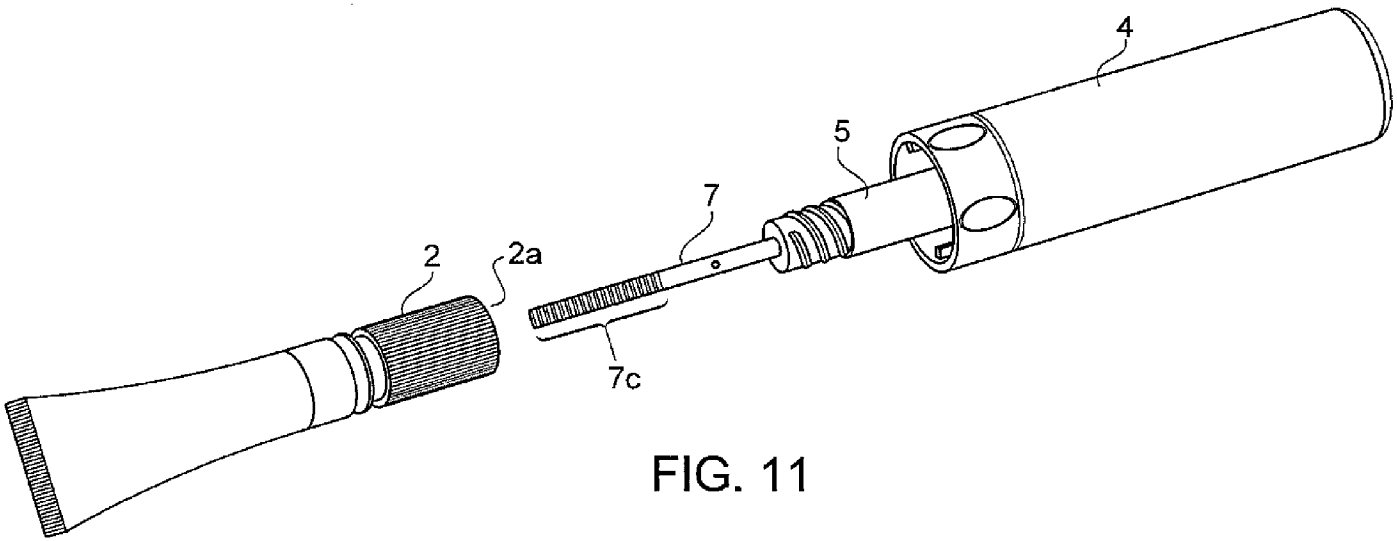
FIG. 11 shows a second subassembly just before being inserted into a first subassembly.

Thus far, we have separately described a first subassembly and a second subassembly. FIG. 11 is one representation of these two subassemblies prior to use. As noted earlier, since the top end (2*a*) of the elongated neck (2) is opened, the interior of the applicator head (3) is accessible from the outside. In particular, the heat generating portion (7*c*) of the electric heating circuit may be inserted into the applicator head.

Figure 12:
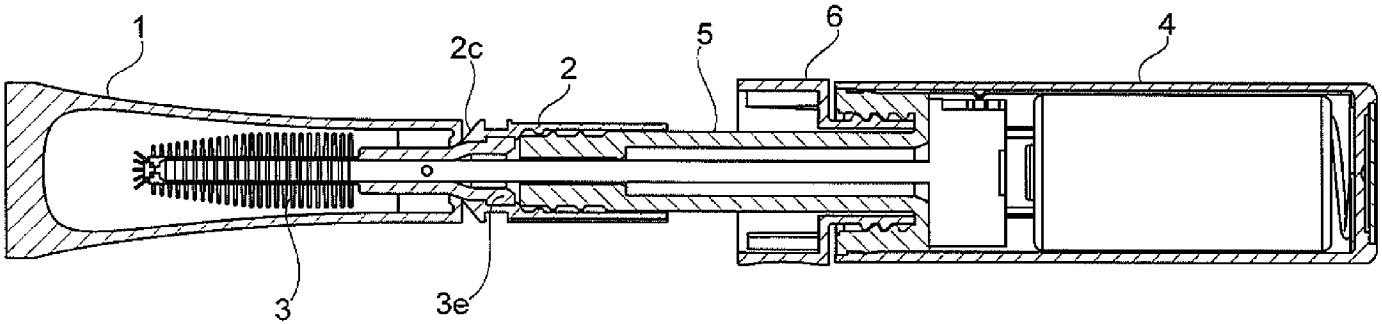
FIG. 12 shows a first subassembly joined to a second subassembly, in one embodiment of the present invention.

At the point of use, a first subassembly whose reservoir (1) contains a sample of product is provided. A second subassembly is also provided. The heat generating portion (7*c*) is inserted into the hollow interior of the applicator head (3), and the electric circuit housing (5) is rigidly attached to the elongated neck (2) (i.e. as by cooperating threads). This configuration is shown in FIG. 12. Once this configuration is achieved, a user has a number of options depending on the order in which she breaks the articulation (2*c*) between the reservoir (1) and elongated neck (2), turns on the heating circuit, and raises the applicator head out of the reservoir. Explanation follows.

In general, the heating of the product can be done while the working surface is in the lower reservoir, or while it is in the wiper element, or after it has been raised out of the reservoir entirely. If the product is heated while the working surface is in the lower reservoir, then a user may break the articulation (2*c*) first, and then turn on the heating circuit (by rotating the collar (6), for example), or she can engage the heating circuit and then break the articulation. Alternatively, if the heating is done while the working surface is in the wiper or out of the reservoir, then the user has to break the articulation first so that the applicator head can be raised.

At whatever point the articulation (2*c*) is broken, the handle (4)-housing (5) combination can be used for leverage to break the connection or articulation (2*c*) between the reservoir (1) and elongated neck (2). Thereafter, the handle, the circuit housing, the elongated neck and the applicator head (3) are able to behave as one, substantially rigid piece.

At whatever point the heating circuit is turned on, the user may wait a recommended amount of time (for example, 30 seconds or less) for the product on the working surface to heat up, and for some characteristic of the product to be improved or enhanced. In general, the actual amount of time for the product to heat will depend on the method used. For example, the longest amount of time may be required when the heating circuit is engaged after the applicator head is out of the reservoir. The second longest amount of time may be required when the working surface is heating as it sits in the lower reservoir. The tight confines of the lower reservoir should improve heating efficiency compared to heating the working surface outside of the reservoir. The least amount of time for heating is expected to occur when the working surface is heated while it is in the wiper element. The even tighter confines of the wiper element, as well as the thermal insulating properties of the wiper element, should improve heating efficiency compared to the other situations described.

Figure 13A:
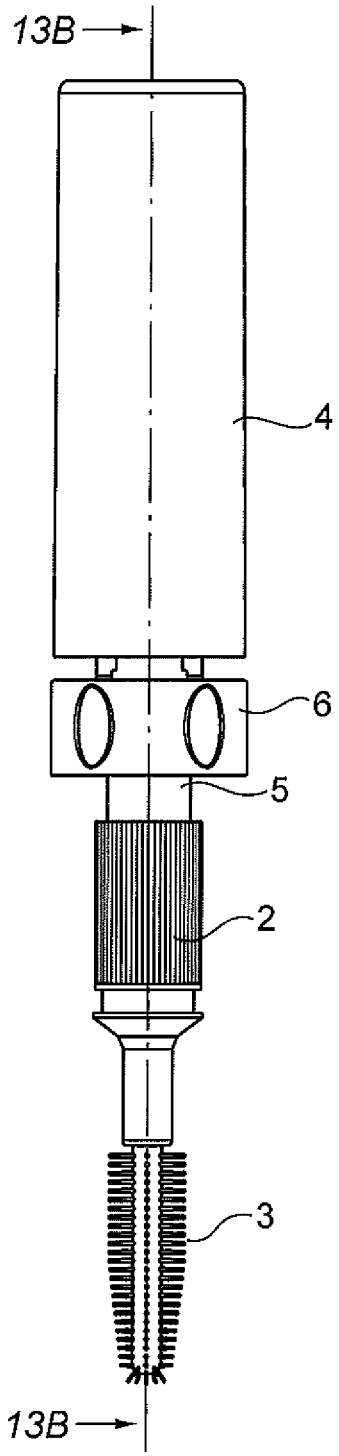
Figure 13B:
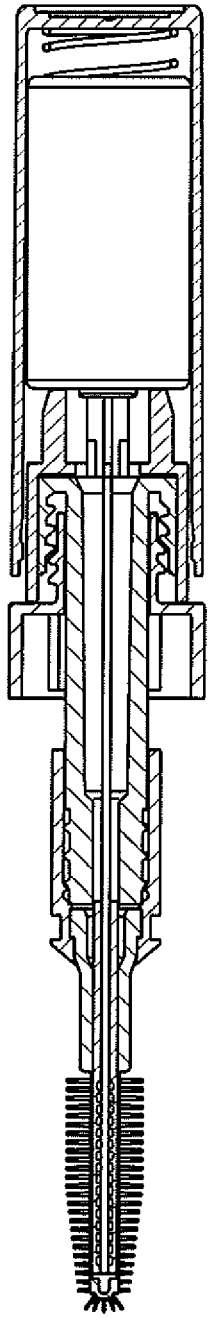

Once the articulation (2*c*) is broken, the applicator head is rigidly associated with the second subassembly, and this is shown in FIGS. 13*a*-13*d*. In particular, FIGS. 13*a* and 13*b* show the applicator in the "on" position. Once raised out of the reservoir (1), the applicator head (3) can be used to transfer heated product to an intended surface, such as hair or skin. If the reservoir is provided with more than one dose of product, then, the applicator head may be returned to the reservoir to retrieve more product. Preferably, for sampling a product at point of sale, the reservoir has enough product for one complete application. For example, if the product is a mascara, then preferably, a user may retrieve enough product from the reservoir to makeup the eyelashes of both eyes.

Figure 13C:
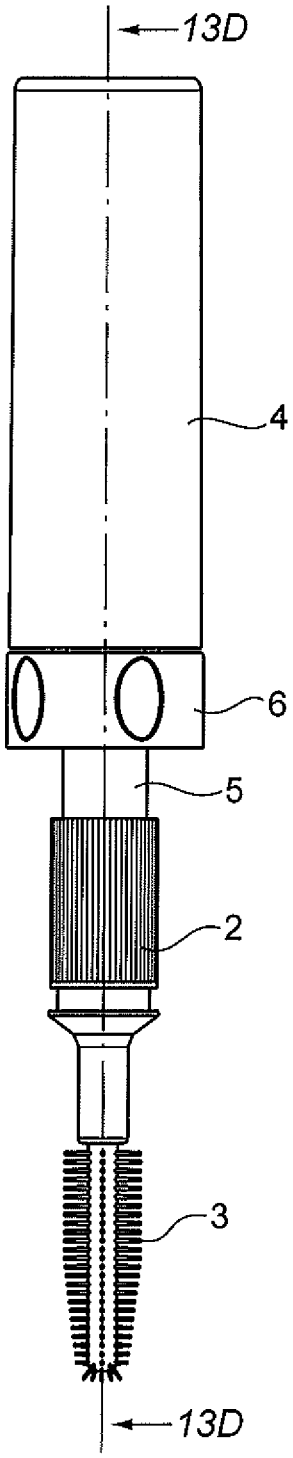
FIGS. 13*c* and 13*d* show a first subassembly joined to a second subassembly, after the elongated neck has been detached from the reservoir. The electric heating circuit is off.
Figure 13D:
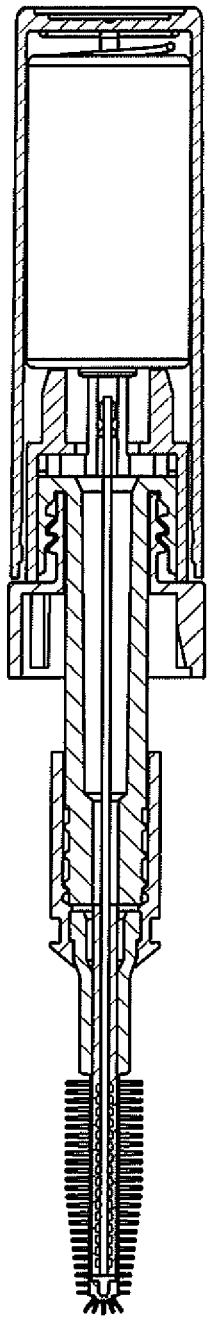

After the applicator has been used, the heating circuit can be turned off. This is shown in FIGS. 13*c* and 13*d*. At this point, the electric circuit housing (5) can be separated from the elongated neck (2) (for example, by unscrewing), and the heat generating portion (7*c*) can be removed from the interior of the applicator head (3). At this point, the second subassembly has been recovered, and may be reused with another first subassembly, to sample a different product or to allow a different customer to sample a product. For hygienic reasons, the used reservoir (1), used applicator head (3), and used elongated neck (2) are disposed.

In some embodiments of the invention, methods of using the invention herein described may include some or all of the following steps. A customer indicates that she'd like to sample a heated product. A sales associate provides a system for sampling a heated product according to the present invention, the system comprising a first subassembly and a physically separate second subassembly. A second subassembly is attached to a first subassembly, such that a heat generating portion is disposed into an applicator head. A user engages an on-off mechanism, and causes electrical power to flow between a current source and heating elements. The user waits a period of time while a portion of product in the reservoir is heated from an ambient temperature to a product application temperature. The user breaks the connection between the reservoir and the elongated neck. (Alternatively, a user breaks the connection between the reservoir and the elongated neck, then raises the working surface until it is in the wiper element. Then the user engages an on-off mechanism, and causes electrical power to flow between a current source and heating elements. The user waits a period of time while a portion of product on the working surface is heated from an ambient temperature to a product application temperature.) At this point, the user removes the applicator head from the reservoir. The user moves the applicator head toward a body surface, and deposits product on the surface. The user reinserts the applicator head into the reservoir, and then repeats the steps of waiting a period of time, removing the applicator head from the reservoir, etc. The user engages an on-off mechanism, and causes electric power to stop flowing to the heating elements. The user separates the second subassembly from the applicator head and elongated neck. The user disposes of the reservoir, elongated neck and applicator head.

The step of waiting a period of time may include the user waiting at least as long as directed by someone or something other than the user. In general, the waiting period may be less than 60 seconds, preferably 30 seconds or less, more preferably 15 seconds or less, even more preferably 10 seconds or less. Alternatively, the user may wait until a thermochromic material has visibly changed color. Some or all of the above steps may be performed at least once per week; for example, at least five times per week; for example, at least once per day; for example, at least twice per day; for example, at least three times per day. A user may perform the steps of opening the removable cap (4*c*), removing a battery (8), replacing a battery, and closing the removable cap.

CONCLUSION

We have described a system for sampling a heated product that alleviates problems that may be encountered in a point of sale setting. With our new system, the most expensive parts of the components are reused, while the tainted components that are disposed are relatively inexpensive. The present invention makes offering a free sample of heated mascara sanitary and cost effective. The present invention is not limited to the embodiments described herein, and is only limited by the appended claims.

We claim:

1. A system for sampling a heated product comprising:

a disposable first subassembly that comprises:

a reservoir that is capable of holding a product, an elongated neck that is connected to the reservoir in a detachable manner, and a hollow applicator head that depends from the elongated neck into the reservoir;

wherein a portion of the applicator head seals off the reservoir from the ambient atmosphere;

a reusable second subassembly that is physically separate from the first subassembly, that comprises:

a handle, a power source located in the handle;

an electric circuit housing that is opened at an upper end and a lower end, that is able to form a rigid, detachable connection to the elongated neck;

an electric heating circuit, that passes through the electric circuit housing, such that a heat generating portion of the heating circuit emerges from the lower end of the housing;

wherein when the electric circuit housing is made to form a rigid connection to the elongated neck, then the heat generating portion is disposed inside the applicator head.

2. A system for sampling a heated product comprising:

a disposable first subassembly that comprises:

a reservoir that is capable of holding a product, an elongated neck that is connected to the reservoir in a detachable manner, and a hollow applicator head that depends from the elongated neck into the reservoir;

wherein a portion of the applicator head seals off the reservoir from the ambient atmosphere; and a reusable second subassembly that comprises:

a handle, a power source located in the handle;

an electric circuit housing that is opened at an upper end and a lower end, that is detachably connected to the elongated neck;

an electric heating circuit, that passes through the electric circuit housing, such that a heat generating portion of the heating circuit emerges from the lower end of the housing into the applicator head.

3. The system of claim 2 wherein a top end (1*a*) of the reservoir is connected to a bottom end of the elongated neck, such that an orifice of the reservoir is surrounded by the elongated neck.

4. The system of claim 3 wherein the reservoir and elongated neck articulate along a surface of joining that is relatively weak compared to the surrounding structure.

5. The system of claim 3 wherein the reservoir comprises a wiper element that is integrally molded around the perimeter of the orifice.

6. The system of claim 2 wherein the lower end of the electric circuit housing is provided with threads that are engaged with threads provided in the elongated neck.

7. The system of claim 2 wherein the electric heating circuit comprises a printed circuit board and the heat generating portion comprises a plurality of individual, discrete resistive heating elements supported on a lower portion of the printed circuit board, outside of the electric circuit housing.

8. The system of claim 7 wherein the printed circuit board comprises a substrate that is non-conductive to electricity, and that supports electronic components and electrical leads that are effective to connect the heat generating portion to the power source.

9. The system of claim 8 that automatically turns off the heat generating portion about 2 to 5 minutes after the heat generating portion has reached a predetermined temperature.

10. The system of claim 9 which includes a voltage divider circuit and a thermistor.

11. The system of claim 10 which further comprises an operational amplifier and an N-channel MOSFET switch.

12. The system of claim 7 wherein the heating elements are a bank of fixed value resistors electronically arranged in series, parallel, or any combination thereof, and physically situated in two rows, one on both sides of the printed circuit board.

13. The system of claim 12 wherein the fixed value resistors have rated resistances from 1 to 10 ohms.

14. The system of claim 13 wherein the overall resistance of all the heating elements ranges from 1 to 10 ohms.

15. The system of claim 12 wherein the resistive heating elements are metal oxide thick film, chip resistors, the largest dimension of which is 2.0 mm or less.

16. The system of claim 12 wherein the resistive heating elements are discrete dots of a metal oxide thick film, provided as a silk screen deposit on the printed circuit board.

17. The system of claim 16 wherein the metal oxide thick film is comprised of ruthenium oxide (RuO2), and each dot is 2.0 mm or less.

18. The system of claim 7 wherein the resistive heating elements are embedded in a continuous, solid mass of a heat transfer material.

19. The system of claim 18 wherein the heat transfer material is one or more thermally conductive adhesives, one or more thermally conductive encapsulating epoxies or a combination of these.

20. The system of claim 2 further comprising an on-off mechanism that has at least two positions, in at least one of the positions the mechanism effects electrical contact between the heat generating portion and the power source, and in at least one of the positions the mechanism interrupts electrical contact between the heat generating portion and the power source, wherein the mechanism is accessible from the outside of the dispenser, and can be engaged, either directly or indirectly, by a user.

21. The system of claim 20 wherein the power source has a terminal, that may alternately occupy at least one "on" position and at least one "off" position, according to the positioning of the on-off mechanism.

22. The system of claim 21 wherein the terminal directly contacts a conductive element on the printed circuit board, when the terminal is on the "on" position.

23. The system of claim 21, wherein the power source is rechargeable.

24. The system of claim 21, wherein the power source is replaceable through a removable cap in the handle.

25. The system of claim 2 wherein a portion of the exterior surface of the reservoir is fashioned from a thermochromic material, such that the thermochromic material changes color within 10 seconds of the product in the chamber reaching a product application temperature.

26. The system of claim 1 wherein the reservoir holds a product comprising less than 10% water.

27. An outer package that includes a set comprising:

a reusable second subassembly that comprises:

a handle, a power source located in the handle;

an electric circuit housing that is opened at an upper end and a lower end, that is adapted to detachably connect to an elongated neck;

an electric heating circuit, that passes through the electric circuit housing, such that a heat generating portion of the heating circuit emerges from the lower end of the housing into the applicator head; and one or more disposable first subassemblies, each comprising:

a reservoir that holds a product, an elongated neck that is connected to the reservoir in a detachable manner, and a hollow applicator head that depends from the elongated neck into the reservoir;

wherein a portion of the applicator head seals off the product in the reservoir from the ambient atmosphere; and wherein all the reservoirs do not contain the same product.

28. The method of using a system for sampling a heated product comprising the steps of:

providing a first subassembly that comprises:

a reservoir that holds a product, an elongated neck that is connected to the reservoir in a detachable manner, and a hollow applicator head having a working surface that depends from the elongated neck into the reservoir;

wherein a portion of the applicator head seals off the product in the reservoir from the ambient atmosphere;

providing a second subassembly physically separate from the first subassembly, comprising:

a handle, a power source located in the handle;

an electric circuit housing that is opened at an upper and a lower end, and an electric heating circuit, that passes through the electric circuit housing, such that a heat generating portion of the heating circuit emerges from the lower end of the housing into the applicator head;

inserting the heat generating portion into the applicator head by connecting the electric circuit housing to the elongated neck;

breaking the connection between the reservoir and elongated neck;

turning on the electric heating circuit;

waiting a recommended amount of time;

raising the applicator head out of the reservoir;

transferring heated product to the hair or skin;

turning off the heating circuit;

separating the electric circuit housing from the elongated neck;

removing the heat generating portion from the interior of the applicator head; and disposing of the reservoir, applicator head, and elongated neck.

29. The method of claim 28 further comprising the step of raising the applicator head until the working surface is located in the wiper element, this step being performed after breaking the connection between the reservoir and elongated neck and before turning on the electric heating circuit.

* * * * *